US011286635B2

(12) United States Patent
Mathis et al.

(10) Patent No.: US 11,286,635 B2
(45) **Date of Patent: *Mar. 29, 2022**

(54) SYSTEM AND METHOD FOR FOUNDATION OF WELLHEADS

(71) Applicant: NeoDrill AS, Ålgård (NO)

(72) Inventors: Wolfgang Mathis, Sandnes (NO); Harald Strand, Ålgård (NO)

(73) Assignee: NeoDrill AS, Algard (NO)

( * ) Notice: Subject to any disclaimer, the term of this patent is extended or adjusted under 35 U.S.C. 154(b) by 0 days.

This patent is subject to a terminal disclaimer.

(21) Appl. No.: 17/173,591

(22) Filed: Feb. 11, 2021

(65) Prior Publication Data

US 2021/0164190 A1 Jun. 3, 2021

Related U.S. Application Data

(63) Continuation of application No. 15/778,438, filed as application No. PCT/NO2016/050238 on Nov. 24, 2016, now Pat. No. 10,961,679.

(51) Int. Cl.
*E02D 27/18* (2006.01)
*E21B 33/043* (2006.01)
(Continued)

(52) U.S. Cl.
CPC ..... *E02D 27/18* (2013.01); *E02D 27/50* (2013.01); *E02D 27/525* (2013.01);
(Continued)

(58) Field of Classification Search
CPC ..... E02D 27/18; E02D 27/50; E02D 27/525; E21B 33/043; E21B 41/0007; E21B 41/08
(Continued)

(56) References Cited

U.S. PATENT DOCUMENTS 3,667,547 A 6/1972 Ahlstone
6,659,182 B1 12/2003 Saugier et al.
(Continued)

FOREIGN PATENT DOCUMENTS

CN 103189592 7/2013
NO 313340 9/2002
(Continued)

OTHER PUBLICATIONS

International Search Report, PCT/NO2016/050238, dated Feb. 23, 2017.
(Continued)

*Primary Examiner* — Matthew R Buck
*Assistant Examiner* — Patrick F Lambe
(74) *Attorney, Agent, or Firm* — Andrus Intellectual Property Law, LLP

(57) ABSTRACT

A wellhead foundation is for one or more subsea wells. The wellhead foundation has a suction foundation provided with a housing with an open bottom and a top which is closable with a top cover, and one or more pipes being attached to the housing and extending from the top of the housing and at least over a substantial part of the vertical extent of the housing towards or beyond the open bottom of the housing inside or outside of the periphery of the housing, and a straight upper portion of each pipe projecting up above the top of the housing and forming an upper well-pipe portion which forms part of a high-pressure barrier in the well. The straight upper pipe portion of each pipe is arranged parallel to the center axis of the housing. A method of establishing a subsea wellhead foundation is described as well.

11 Claims, 5 Drawing Sheets

(51) Int. Cl.

| | |
|---|---|
| ***E02D 27/50*** | (2006.01) |
| ***E02D 27/52*** | (2006.01) |
| ***E21B 41/00*** | (2006.01) |
| *E21B 41/08* | (2006.01) |

(52) U.S. Cl.
CPC ..... *E21B 33/043* (2013.01); *E21B 41/0007* (2013.01); *E21B 41/08* (2013.01)

(58) Field of Classification Search
USPC ..... 166/335
See application file for complete search history.

(56) References Cited

U.S. PATENT DOCUMENTS

| | | | | |
|---|---|---|---|---|
| 8,122,618 | B2 * | 2/2012 | Van Rompay | E02F 3/8841 37/195 |
| 9,564,748 | B2 | 2/2017 | Strand | |
| 10,151,166 | B2 | 12/2018 | Mathis | |
| 10,221,539 | B2 | 3/2019 | Mathis et al. | |
| 10,253,569 | B2 * | 4/2019 | Ellison | E21B 33/043 |
| 10,287,840 | B2 | 5/2019 | Strand et al. | |
| 10,301,790 | B2 | 5/2019 | Strand et al. | |
| 2003/0029620 | A1 * | 2/2003 | Strand | E21B 41/0007 166/367 |
| 2012/0003048 | A1 * | 1/2012 | Hosoy | E21B 33/043 405/172 |
| 2013/0220206 | A1 | 8/2013 | Moeged et al. | |
| 2013/0240215 | A1 | 9/2013 | Chung | |
| 2014/0069657 | A1 | 3/2014 | Povloski | |
| 2015/0010365 | A1 | 1/2015 | Nielsen et al. | |
| 2016/0208453 | A1 | 7/2016 | Larsen et al. | |

FOREIGN PATENT DOCUMENTS

| | | |
|---|---|---|
| WO | 2010068119 | 6/2010 |
| WO | 2011162616 | 12/2011 |
| WO | 2012002818 | 1/2012 |
| WO | 2012123431 | 9/2012 |
| WO | 2013167872 | 11/2013 |
| WO | 2014116119 | 7/2014 |
| WO | 2015054766 | 4/2015 |
| WO | 2015118348 | 8/2015 |

OTHER PUBLICATIONS

Norwegian Search Report, Norwegian Patent Application No. 20151608, dated Jun. 21, 2016.
Norwegian Search Report, Norwegian Patent Application No. 20161083, dated Jan. 23, 2017.
Norwegian Search Report, Norwegian Patent Application No. 20161816, dated Jun. 15, 2017.
Written Opinion, PCT/N02016/050238, dated Feb. 23, 2017.

* cited by examiner

SYSTEM AND METHOD FOR FOUNDATION OF WELLHEADS

CROSS REFERENCE TO RELATED APPLICATIONS

This application is a continuation of U.S. patent application Ser. No. 15/778,438, filed May 23, 2018, which is the U.S. national stage application of International Application PCT/NO2016/050238, filed Nov. 24, 2016, which international application was published on Jun. 1, 2017, as International Publication WO 2017/091085 in the English language. The International Application claims priority of Norwegian Patent Application No. 20151608, filed Nov. 25, 2015, Norwegian Patent Application No. 20161083, filed Jun. 29, 2016, and Norwegian Patent Application No. 20161816, filed Nov. 17, 2016. All of which applications are incorporated herein by reference, in entirety.

FIELD

The invention relates to a wellhead foundation for one or more subsea wells, the wellhead foundation comprising a suction foundation provided with a housing with an open bottom and a top which is closable with a top cover, and one or more high-pressure-barrier pipes being attached to the housing and extending from the top of the housing and at least over a substantial part of the vertical extent of the housing towards or beyond the open bottom of the housing inside or outside the periphery of the housing.

BACKGROUND

The establishment of a subsea well, for example a petroleum well, is conditional on a wellhead, which is arranged on the seabed, being stabilized in such a way that strain, for example lateral forces, to which the wellhead Christmas tree is subjected because of currents in the surrounding water masses is transmitted to the seabed masses surrounding the top part of the wellbore. The stabilization is typically provided by a conductor casing, which defines the top part of the wellbore against the surrounding unconsolidated masses, being cemented against the unconsolidated masses after, for example, the conductor casing has been lowered into a drilled hole or been driven down into the unconsolidated masses by an impacting device. The conductor casing forms a low-pressure barrier in the well and is connected to a low-pressure housing in the wellhead. Through the conductor casing and further through an established borehole a well pipe that forms a high-pressure barrier in the well is extended. An improved stabilization is achieved by the wellhead being provided with a well frame, which is supported on the seabed. The applicant's own suction foundation (Conductor Anchor Node=CAN) as described in NO 313340 B1 and the corresponding US2003029620 A1 provides a larger contact area between the upper part of the conductor casing and the surrounding seabed mass in order thereby to further increase the stability of the wellhead. Preferably, the conductor casing is extended through a supporting pipe, which is typically centered in the suction foundation and secured to the top cover of the suction foundation and to a lower portion of the skirt of the suction foundation.

The establishing of a wellhead is laborious and especially the installation of a conductor casing may result in unconsolidated masses around the conductor casing and wellhead foundation being washed out. The risk of such washouts occurring depends on several factors, among them the properties of the unconsolidated masses. Measures are therefore needed in order to reduce the risk of such washouts.

There is also a need to be able to establish several wellheads on the same foundation without this resulting in the foundation having to have a size, which makes the installation unduly demanding because of the dimension and weight.

WO2015054766 discloses the installation of conductor casings, that is to say a low-pressure barrier, in a seabed, with an assembly of one or more suction foundations with one or more integrated pipes extending in the full height of the suction foundation, inside or on the outside of the suction foundation(s) and projecting up above the top of the suction foundation(s). The suction foundation(s) is/are provided with a top cover/top covers closing the top(s) of the suction foundation(s).

WO2015118348 discloses an apparatus for installing a wellbore in a seabed, in which the upper end of the suction foundation is provided with a wellhead for engagement with a conductor casing, that is to say a low-pressure barrier, extending through the housing of the suction foundation.

There is a need to be able to reduce the expenditure of resources when establishing subsea wells in relation to the present-day technique in which the high-pressure barrier is provided inside a low-pressure barrier in the form of conductor casing extending through at least the upper layers of the unconsolidated masses of a seabed.

SUMMARY

The invention has for its object to remedy or reduce at least one of the drawbacks of the prior art or at least provide a useful alternative to the prior art.

The object is achieved through the features that are specified in the description below and in the claims that follow.

A wellhead foundation is provided for subsea wells for the exploration for or/and production of petroleum, for example, or for the injection of gas or water, for example. The wellhead foundation comprises a suction foundation in which a housing is provided with an open bottom and a top cover, which, at least during the installation of the suction foundation, closes the top of the suction foundation. The ground plan of the housing may be circular, elliptical, oval or polygonal. The wall(s) of the housing is/are tight, so that a negative pressure may be created inside the housing. In the suction foundation, at least one pipe is arranged, which is arranged to form an upper well-pipe portion that forms part of a high-pressure barrier in the subsea well. Said pipe extends from the top of the housing and at least over a substantial part of the vertical extent of the housing towards or beyond the open bottom of the housing inside or outside of the periphery of the housing. An upper portion of said pipe is straight and is preferably standing vertically when the suction foundation is positioned in a seabed, the straight pipe portion lying substantially parallel to the center axis of the suction foundation. A portion of the pipe lying below may be straight or deflected. A deflected pipe may extend through an opening in the wall of the housing. If a pipe extends through the top cover of the housing or through the wall of the housing, the top cover and the wall fit tightly around the pipe. Said pipe is braced against the housing. The suction foundation is provided, in a manner known per se, with at least one connection for a suction line, for the internal space of the suction foundation to be evacuated so that surrounding water masses can drive the suction foundation down into unconsolidated masses in a seabed.

The housing may be divided into several chambers by means of internal walls arranged vertically. It is thereby possible to have different negative pressures in the different portions of the housing. The verticality of the housing can thereby be adjusted by means of the negative pressure.

In the operative state of the suction foundation, said pipe may extend out of the open bottom of the housing or the wall of the housing, said pipe having or being given a length adapted to the properties of the unconsolidated masses into which the suction foundation is going to be set. If said pipe does not extend beyond the open lower end of the housing during transport, the transport and deployment of the suction foundation may be simplified, as, in this embodiment, the suction foundation may be transported upright on a vessel deck. If, in an operative state, said pipe is going to have a length extending down below the skirt of the suction foundation or outwards from the wall of the housing, said pipe may be formed in various ways. In one embodiment, said pipe may be manufactured with the desired, fixed length and be attached to the housing. In this embodiment it is the most obvious to transport the suction foundation lying down. In another embodiment said pipe may be formed as a telescopic pipe which is extended while or after the suction foundation is being/has been put down, for example while the suction foundation is hanging from a lifting device on an installation vessel or by the use of an underwater hammer after the suction foundation has been driven into the unconsolidated masses. A further way of providing a lengthened pipe is to join an extension to the pipe while the suction foundation is placed in an upright position, hanging from a lifting device on an installation vessel, possibly standing on a framework projecting from the hull of the vessel or across a moon pool of the vessel.

When installing a suction foundation with one or more lengthened pipes, it is an advantage if boreholes that can accommodate at least some of the straight pipes have been established in the unconsolidated masses. In unconsolidated masses having the right properties, the pipes may be driven down into the unconsolidated masses by the weight of the suction foundation and the water pressure on the evacuated suction foundation. This may also apply to deflected pipes.

Since the suction foundation has a great carrying capacity and provides good support against all the typical loads to which a subsea well may be subjected throughout the life of the well, that is to say during establishment, production, maintenance and removal, the invention opens to the possibility of establishing wells without the use of conductor casings, as each of the pipes integrated in the suction foundation constitutes the top portion of the well pipe forming the high-pressure barrier in the well. Thereby wells may be established at lower costs, as the costs of installing the conductor casing and connecting the conductor casing to a low-pressure housing in the wellhead are avoided. In addition, the connection between the upper portion of the well pipe and the suction foundation may be optimized, as there is easy access to the connecting portions when the wellhead foundation is being made. A further advantage is that several wellheads may be established on a suction foundation in that several pipes may be placed with good spacing near and within the periphery of the suction foundation, possibly also outside the periphery of the suction foundation, and the well pipes may be given a deflection even before they leave the suction foundation.

When a pipe extends down below the skirt of the suction foundation or outwards from the wall of the suction foundation, the pipe may be provided with a weakening inside the portion that is inside or at the periphery of the suction foundation to simplify a shutting down and abandoning of the well(s). Such a weakening may result in the suction foundation being easier to pull up and recover.

The invention is defined by the independent claims. The dependent claims define advantageous embodiments of the invention.

In a first aspect, the invention relates more specifically to a wellhead foundation for one or more subsea wells, the wellhead foundation comprising a suction foundation provided with a housing with an open bottom and a top which is closable with a top cover, and one or more pipes being attached to the housing and extending from the top of the housing and at least over a substantial part of the vertical extent of the housing towards or beyond the open bottom of the housing inside or outside the periphery of the housing, characterized by

- a straight upper portion of each pipe projecting up above the top of the housing and forming an upper well-pipe portion which forms part of a high-pressure barrier in the well, and
- the straight upper pipe portion of each pipe being arranged parallel to the center axis of the housing.

The straight upper pipe portion of said pipe may be arranged eccentrically in the suction foundation.

A deflected pipe may extend through the top cover and at least to a wall opening in the housing, the wall opening fitting tightly against the periphery of the deflected pipe.

Alternatively, a deflected pipe may extend through the top cover and towards a skirt edge of the housing.

The pipe may be lengthenable.

The pipe may be telescopingly lengthenable beyond the open bottom of the housing by means of one or more telescope sections. Alternatively, the pipe may be joinably lengthenable beyond the open bottom of the housing by means of one or more pipe sections.

Several pipes may be evenly distributed inside and/or outside the periphery of the housing.

At least one straight or deflected pipe may be arranged outside of the periphery of the housing.

The housing may be provided with several internal walls that form several separate chambers, which are each provided with a suction-line connection.

In a second aspect, the invention relates more specifically to a method of establishing a subsea wellhead foundation, the method comprising the steps of

- providing a suction foundation as described above;
- placing the suction foundation in an upright position over a location on a seabed for establishing subsea wells, characterized by the method including the further steps of
- bringing a skirt edge of the suction foundation into abutment on the seabed;
- driving one or more pipes attached to a suction-foundation housing and a skirt of the suction-foundation housing down into an unconsolidated mass, said pipe(s) projecting up above the top of the housing and forming an upper well-pipe portion, which forms part of a high-pressure barrier in the wells.

The method may include the further step of before the suction foundation is brought into abutment against the seabed, lengthening at least one of the pipes.

The method may include the further step of after the suction foundation has been set into the seabed, lengthening at least one of the pipes.

The method may include the further step steps of before the suction foundation is driven down into the unconsolidated mass, forming a borehole/boreholes in the unconsolidated mass, corresponding to one or more straight pipes integrated in the suction foundation;

placing the suction foundation on the seabed in such an orientation that the straight pipe or pipes are arranged over the respective boreholes; and moving the straight pipes down into the respective boreholes by driving the skirt of the housing down into the unconsolidated mass.

BRIEF DESCRIPTION OF THE DRAWINGS

In what follows, examples of preferred embodiments are described, which are illustrated in the accompanying drawings, in which.

DETAILED DESCRIPTION OF THE DRAWINGS

Figure 1:
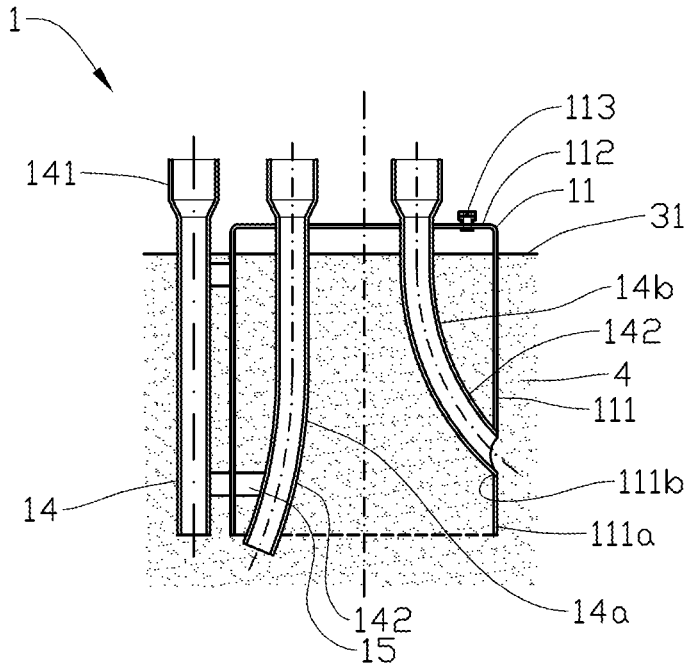
FIG. 1 shows an axial section through a cylinder-shaped suction foundation, in which several pipes in the form of the upper portions of well pipes are attached to the suction foundation, a straight well pipe being attached to the outside of the suction foundation, a slightly deflected well pipe being attached internally in the suction foundation and extending to the lower skirt edge of the suction foundation, whereas a greatly deflected well pipe is attached in the side wall of the suction foundation.

Reference is first made to FIG. 1, in which the reference numeral 1 indicates a suction foundation provided with a cylindrical housing 11 forming a wall 111, also called a skirt. The housing 11 has an open bottom 114 defined by a lower wall edge 111*a*, also called a skirt edge. The housing 11 has a top, which is closed by means of a top cover 112. Several well pipes 14, 14*a*, 14*b* extend downwards from above the top of the suction foundation 1. A straight first well pipe 14 is attached to the outside of the housing 11; a slightly deflected second well pipe 14*a* extends through an opening 112*a* in the top cover 112 and through the housing 11 and has its mouth at the skirt edge 111*a*. Said second well pipe 14*a* is supported against the wall 111 by means of a pipe mount 15. A greatly deflected third well pipe 14*b* extends through the housing 11 to an opening 111*b* in the wall 111 where said well pipe 14*b* is attached and fits tightly against the periphery of the wall opening 111*b*. The top cover 112 fits tightly against the second and third well pipes 14*a*, 14*b*. All the well pipes 14, 14*a*, 14*b* have a straight upper well-pipe portion 141 arranged parallel to the center axis of the housing 11. The deflected well pipes 14*a*, 14*b* include a curved lower well-pipe portion 142.

The skirt 111 and well pipes 14, 14*a*, 14*b* of the suction foundation 1 have substantially been driven down into an unconsolidated mass 4 forming a seabed 31.

In a manner known per se, a negative pressure may be created inside the housing 11 when the suction foundation 1 is standing on the seabed 31 by the housing 11 being evacuated of water through one or more suction-line connections 113. Thereby the suction foundation 1 is driven down into the unconsolidated mass 4 by the pressure from an overlying water mass.

Each of the well pipes 14, 14*a*, 14*b* as shown in FIG. 1 are arranged to be lengthened so that a high-pressure barrier is formed down through the unconsolidated masses from an upper well pipe portion 141 projecting up above the suction foundation 1 in order to form a high-pressure wellhead housing in a manner known per se.

Figure 2:
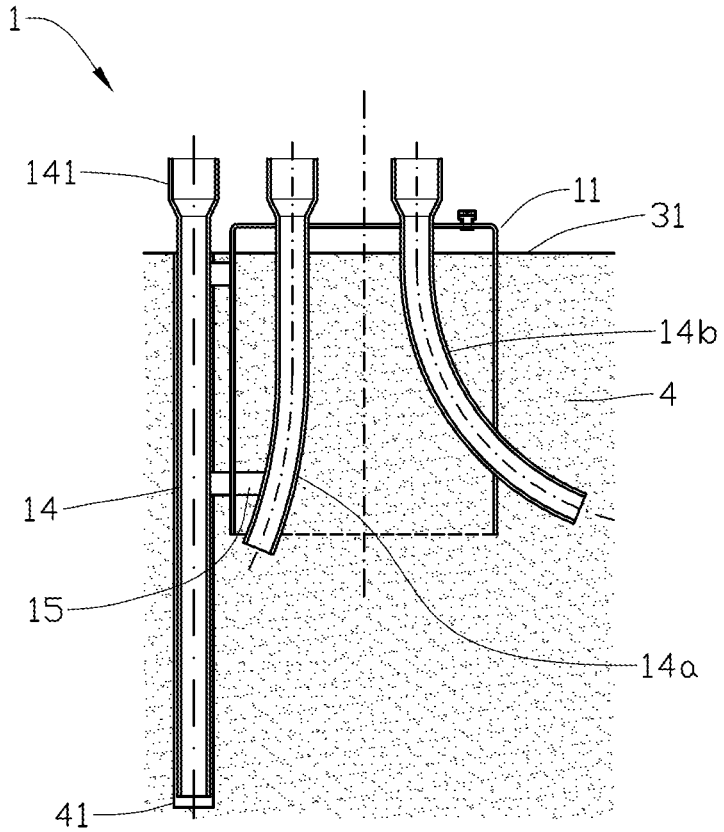
FIG. 2 shows an axial section corresponding to FIG. 1, but the straight well pipe attached to the outside of the suction foundation has been lengthened and extends way down below the skirt edge of the suction foundation through a predrilled hole in an unconsolidated mass, and the greatly deflected well pipe extends out from the side wall of the suction foundation.
Figure 3:
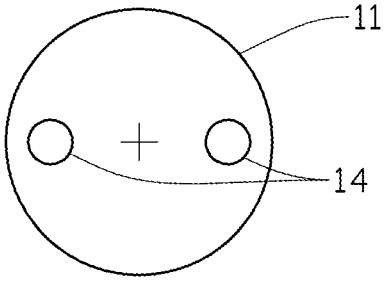
FIG. 3 shows a simplified plan view, on a smaller scale, of a cylinder-shaped suction foundation with pipes arranged inside the periphery of the suction foundation.

The well pipe 14 forms a stable boundary of a borehole in the unconsolidated mass 4 in a manner known per se. In FIG. 2, the different well pipes 14, 14*a*, 14*b* are shown with different lengths downwards in the unconsolidated mass 4.

The invention enables an optimization of the wellhead foundation by the good carrying capacity of the suction foundation 1 being turned to account, and conductor casings (not shown) of a prior art known per se may be omitted as supporting elements.

It may be an advantage to form a borehole 41 (see FIG. 2) that can accommodate a lengthened well pipe 14, before the suction foundation 1 is put down on the seabed 31.

When there is a need to lengthen the well pipes 14 further, this may happen by telescopic well-pipe sections (not shown) being driven down through the integrated portions of the well pipes 14, 14*a*, 14*b*, for example. The establishing of the complete wellbore by drilling and installing further well pipes 14, 14*a*, 14*b* happens in the ordinary way through the integrated portions of the well pipes 14, 14*a*, 14*b*.

The installation of a suction foundation 1 with well pipes 14, 14*a*, 14*b* may be carried out in the ways shown in FIGS. 8*a*-8*c*, 9*a*-9*c* and 10*a*-10*c*.

Figure 8A:
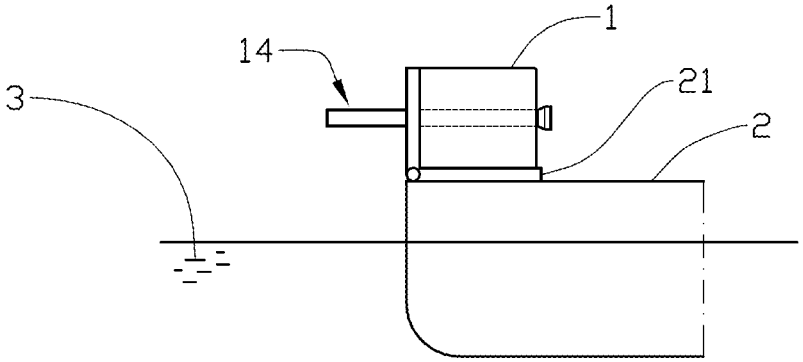
FIGS. 8*a-c* show principle drawings, in side views, of the deployment of a suction foundation with a projecting portion of a well pipe, FIG. 8*a* showing the suction foundation in a horizontal position during transport on a vessel, FIG. 8*b* showing the suction foundation in an upright position on a framework projecting from the vessel, and FIG. 8*c* showing the suction foundation hanging from a lifting device, in the process of being lowered into a water mass.
Figure 8B:
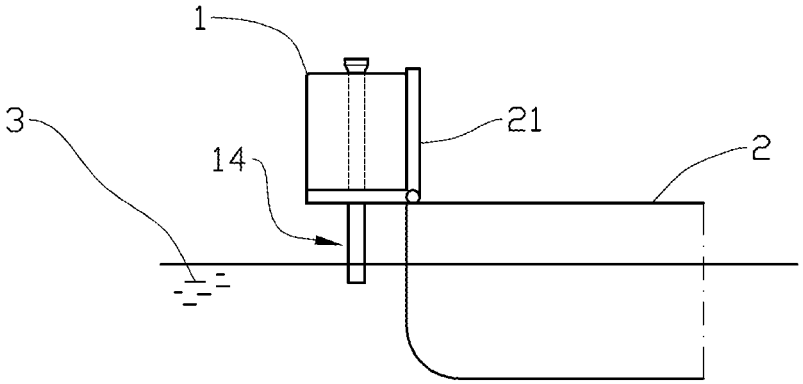
Figure 8C:
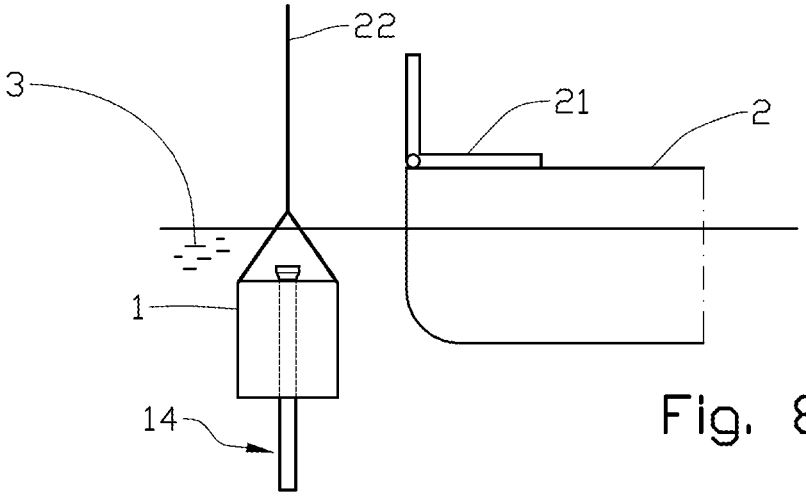

FIG. 8*a* shows a suction foundation 1 with a well pipe 14 that extends out of the suction foundation 1. Because of that, it is transported in a lying position on a shiftable framework 21 on a vessel 2. When the suction foundation 1 is to be put down on the seabed 31, the suction foundation 1 is put into the upright position by means of the framework 21, see FIG. 8*b*. Then the suction foundation 1 is connected to a lifting device 22, typically a crane, and lowered through a water mass 3 to the seabed 31 (see FIG. 8*c*) where the suction foundation 1 with the well pipe 14 is driven down into the unconsolidated mass 4, after which the well is established through the suction foundation 1.

Figure 9A:
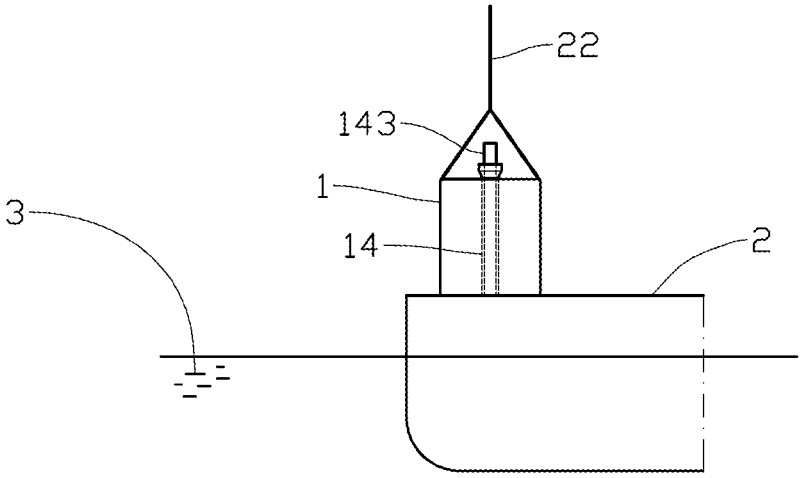
FIGS. 9*a-c* show principle drawings, in side views, of the deployment of a suction foundation with a telescopically lengthenable portion of the well pipe, FIG. 9*a* showing the suction foundation with a retracted well pipe during transport on the vessel, FIG. 9*b* showing the suction foundation hanging from the lifting device before the well pipe has been extended, and FIG. 9*c* showing the suction foundation after the well pipe has been extended and the suction foundation is in the process of being lowered into the water mass.
Figure 9B:
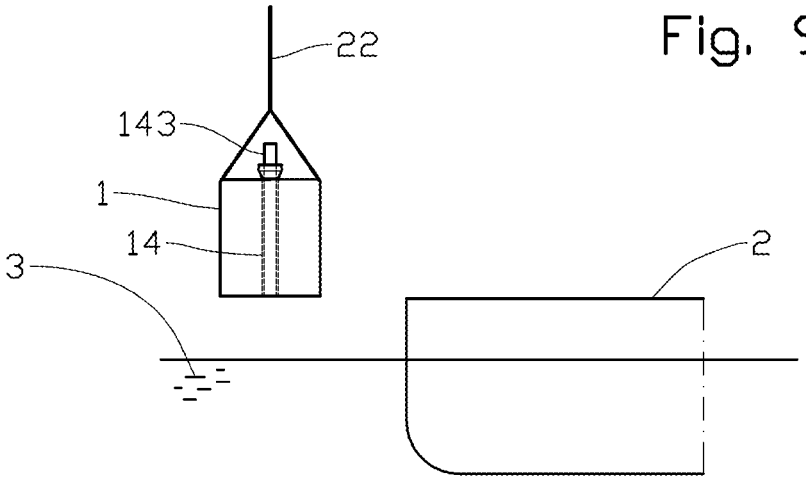
Figure 9C:
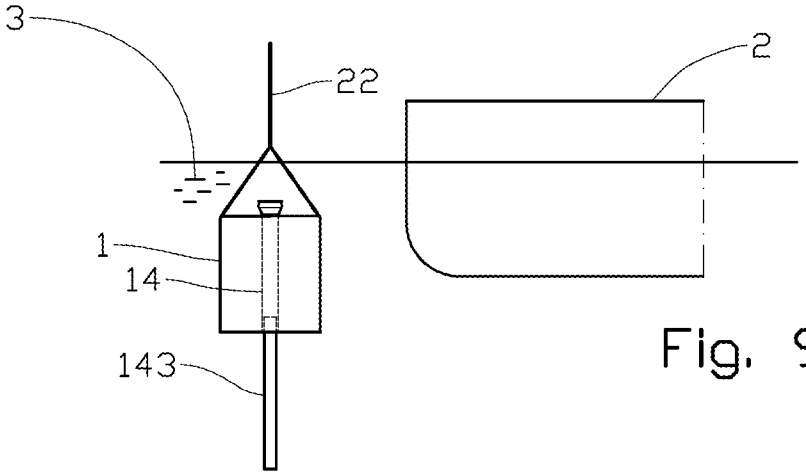

FIGS. 9*a*-9*c* correspondingly show a suction foundation 1 with a telescopic well pipe 14 which is retracted during the transport of the suction foundation 1, but which is lengthened, after the suction foundation 1 has been lifted up from the vessel 2, by a telescope section 143 being released from its retracted position and then secured to the well pipe 14 in its extended position. Alternatively, the telescopic well pipe 14 may be lengthened while the suction foundation 1 is standing on a framework 21 as shown in FIGS. 10*a*-10*c*.

Figure 10A:
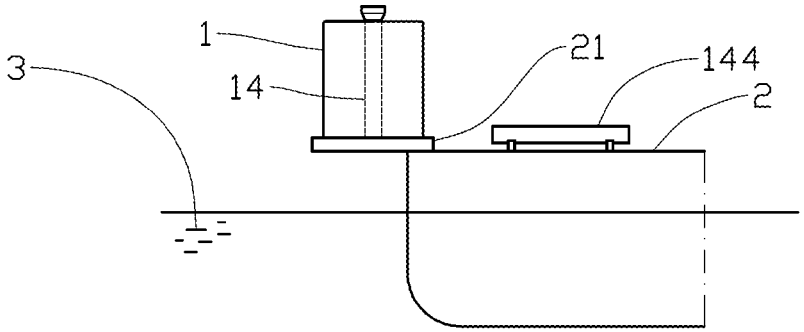
FIGS. 10*a-c* show principle drawings, in side views, of the deployment of a suction foundation with a portion of the well pipe which is lengthened by joining before the suction foundation is lowered into the water mass, FIG. 10*a* showing a pipe section lying on the vessel and the suction foundation standing on a framework projecting from the vessel, FIG. 10*b* showings the suction foundation standing on the framework and being connected to the lifting device prepared for lowering into the water mass, the well pipe having been lengthened with the pipe section, and FIG. 10*c* showing the suction foundation in the process of being lowered into the water mass.
Figure 10B:
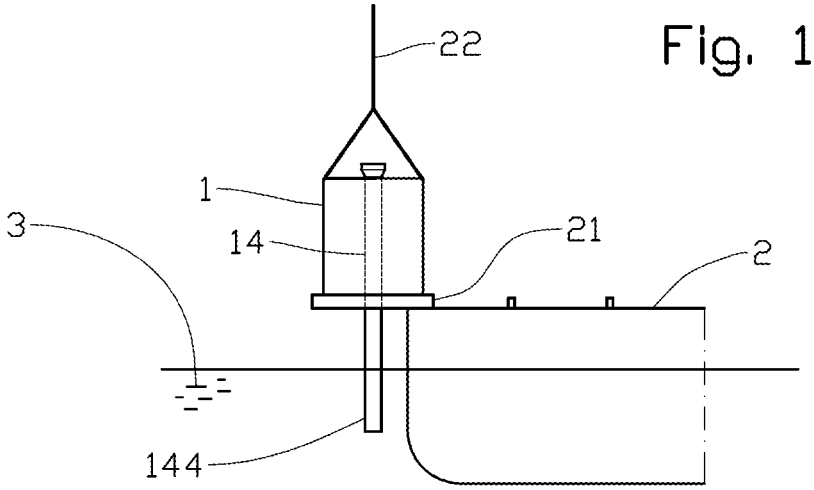
Figure 10C:
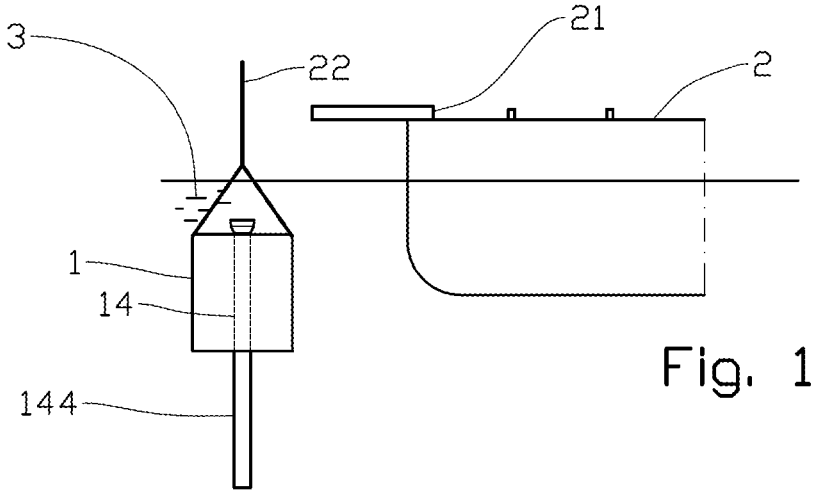

FIGS. 10*a*-10*c* show an embodiment in which the well pipe 14 is having a pipe section 144 joined to it, which, during transport of the suction foundation 1, is separate from the suction foundation 1, indicated in FIG. 10*a* as lying on the vessel 2. The joining takes place while the suction foundation 1 is standing on a framework 21 projecting from the vessel 2.

Figure 6:
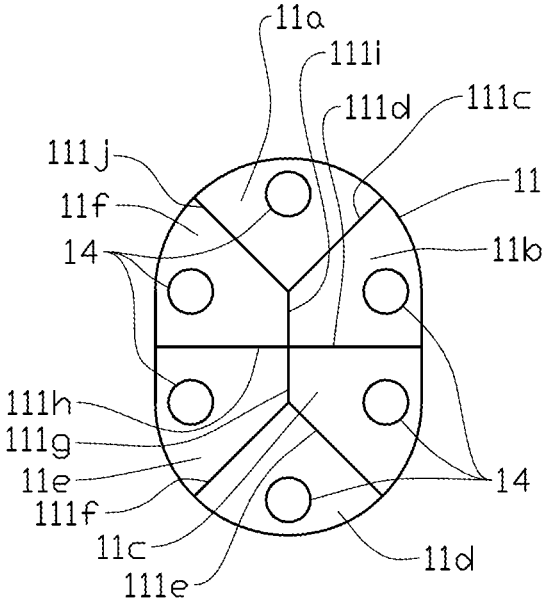
FIG. 6 shows a simplified plan view of an oval suction foundation with pipes arranged inside the periphery of the suction foundation, the housing being divided into several chambers.
Figure 4:
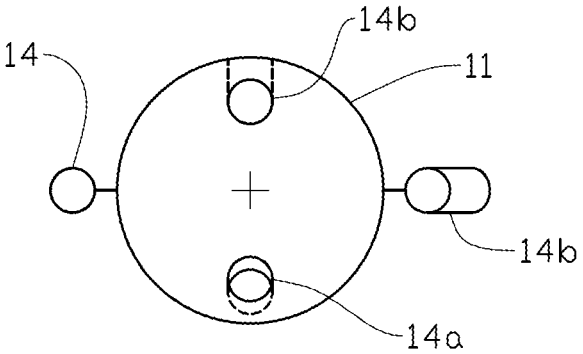
FIGS. 4 and 5 show simplified plan views of a cylinder-shaped suction foundation with pipes arranged inside and outside the periphery of the suction foundation.
Figure 7:
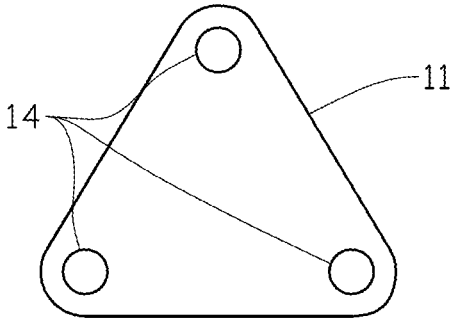
FIG. 7 shows a simplified plan view of a triangle-shaped suction foundation with pipes arranged near the corners of the suction foundation and inside the periphery of the suction foundation.
Figure 5:
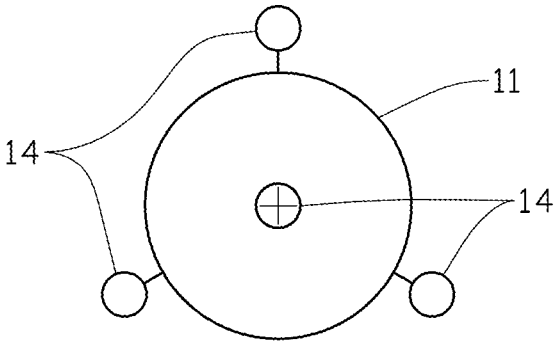

FIGS. 3-7 show examples of suction foundations 1 having different ground plans and positionings of integrated well pipes 14 inside and outside the periphery of the housing 11. In FIG. 4, several pipes 14, 14*a*, 14 having different deflections outwards from the center axis of the suction foundation 1 are indicated. In FIG. 6, the housing is divided into several chambers 11*a*-11*f* by means of internal walls 111*c*-111*j*. Each chamber is preferably provided with a suction-line connection 113 (see FIG. 1) for the negative pressure of each chamber 11*a*-11*f* to be adjustable independently of the negative pressures of the other chambers 11*a*-11*f*. At least some of the chambers may be provided with means not shown, typically sensors that can be connected to a remote control system not shown, for recording pressures and the occurrence of gases.

The suction foundation 1 may be provided with means not shown for registering verticality.

The suction foundation 1 may also be provided with arrangements not shown, typically guiding elements, for receiving equipment that is to be connected to the suction foundation 1 during well establishment, well maintenance or well shut-down.

It should be noted that all the above-mentioned embodiments illustrate the invention, but do not limit it, and persons skilled in the art may construct many alternative embodiments without departing from the scope of the attached claims. In the claims, reference numbers in parentheses are not to be regarded as restrictive.

The use of the verb "to comprise" and its different forms does not exclude the presence of elements or steps that are not mentioned in the claims. The indefinite article "a" or "an" before an element does not exclude the presence of several such elements.

The fact that some features are indicated in mutually different dependent claims does not indicate that a combination of these features cannot be used with advantage.

The invention claimed is:

1. A wellhead foundation for one or more subsea wells, the wellhead foundation comprising:

a housing comprising:

a top wall;

an external wall extending vertically downward from an outer perimeter of the top wall to define an interior region of the housing, the external wall terminating at a skirt edge; and one or more internal walls extending vertically downward from the top wall and within the interior region such that the one or more internal walls divides the interior region into a plurality of suction chambers; and a plurality of suction-line connections, each respective suction-line connection in the plurality of suction-line connections being operably connected to a different suction chamber in the plurality of suction chambers;

a plurality of well pipes that each have an upper well-pipe portion located vertically above the top wall of the housing and a lower well-pipe portion extending vertically below the top wall of the housing;

wherein the skirt edge of the external wall, the one or more internal walls, and the lower well-pipe portion of each of the plurality of well pipes are configured to be driven at least partially into unconsolidated masses in a seabed by evacuating water from the plurality of suction chambers via the plurality of suction-line connections;

wherein a negative pressure of each respective suction chamber is independently adjustable via the respective suction-line connection to thereby facilitate control of a verticality of the housing; and wherein at least one well pipe in the plurality of well pipes is coupled to and located outside the housing.

2. The wellhead foundation according to claim 1, wherein the upper well-pipe portion of each of the plurality of well pipes is arranged parallel to a vertical axis extending through a center of the housing.

3. The wellhead foundation according to claim 2, wherein the upper well-pipe portion of each of the plurality of well pipes is arranged eccentrically relative to the center of the housing.

4. The wellhead foundation according to claim 2, wherein at least one lower well-pipe portion in the plurality of well pipes is not arranged parallel to the vertical axis extending through the center of the housing.

5. The wellhead foundation according to claim 1, wherein at least one lower well-pipe portion in the plurality of well pipes is a lengthenable lower well-pipe portion.

6. The wellhead foundation according to claim 5, wherein the lengthenable lower well-pipe portion comprises one or more telescope sections movable between a retracted position and an extended position.

7. The wellhead foundation according to claim 5, wherein the lengthenable lower well-pipe portion comprises one or more pipe sections configured to be joined to the lengthenable lower well-pipe portion.

8. The wellhead foundation according to claim 1, wherein at least one lower well-pipe portion in the plurality of well pipes extends through at least a lower portion of a respective one of the plurality of suction chambers.

9. A method of establishing a subsea wellhead foundation, the method comprising:

providing a wellhead foundation comprising:

a housing comprising:

a top wall;

an external wall extending vertically downward from an outer perimeter of the top wall to define an interior region of the housing, the external wall terminating in a skirt edge; and one or more internal walls extending vertically downward from the top wall and within the interior region to divide the interior region into a plurality of suction chambers;

a plurality of suction-line connections, each respective suction-line connection in the plurality of suction-line connections being operably connected to a different suction chamber in the plurality of suction chambers; and a plurality of well pipes that each have an upper well-pipe portion located vertically above the top wall of the housing and a lower well-pipe portion extending vertically below the top wall of the housing;

wherein at least one well pipe in the plurality of well pipes is coupled to and located outside the housing;

placing the wellhead foundation in an upright position over a location on a seabed for the establishment of one or more subsea wells;

driving the skirt edge of the external wall, the one or more internal walls, and the lower well-pipe portion of each of the plurality of well-pipes at least partially into unconsolidated masses in the seabed by evacuating water from the plurality of suction chambers through the plurality of suction-line connections, and independently adjusting a negative pressure of each respective suction chamber by the respective suction-line connection to control a verticality of the housing.

10. The method according to claim 9, further comprising:

forming a plurality of boreholes in the seabed, wherein each respective borehole in the plurality of boreholes is associated with one respective lower well-pipe portion in the plurality of well pipes; and orienting the wellhead foundation such that each respective lower well-pipe portion is arranged over each respective borehole such that driving the skirt edge of the external wall into the unconsolidated masses in the seabed moves each respective lower well-pipe portion into each respective borehole.

11. The method according to claim 9, further comprising:

lengthening at least one of the lower well-pipe portions prior to driving the skirt edge of the external wall into the unconsolidated masses in the seabed.

* * * * *